US005737915A

United States Patent [19]

Lin et al.

[11] Patent Number: 5,737,915

[45] Date of Patent: Apr. 14, 1998

[54] TRI-PASSAGE DIFFUSER FOR A GAS TURBINE

[75] Inventors: Edward J. C. Lin; Richard Edwin Warren, Jr., both of Schenectady; Christian L. Vandervort, Voorheesville, all of N.Y.

[73] Assignee: General Electric Co., Schenectady, N.Y.

[21] Appl. No.: 598,885

[22] Filed: Feb. 9, 1996

[51] Int. Cl.[6] ..... F02C 7/00

[52] U.S. Cl. ..... 60/251; 415/207; 415/211.2

[58] Field of Search ..... 60/751, 39.36, 60/752, 754; 415/182.1, 207, 208.1, 208.2, 211.2

[56] References Cited

U.S. PATENT DOCUMENTS

| | | | |
|---|---|---|---|
| 2,991,927 | 7/1961 | Quick | 415/208.2 |
| 3,552,877 | 1/1971 | Christ et al. | 415/211.2 |
| 3,877,221 | 4/1975 | Lefebvre et al. | 60/751 |
| 4,291,531 | 9/1981 | Campbell | 60/751 |
| 5,077,967 | 1/1992 | Widener et al. . | |
| 5,209,066 | 5/1993 | Barbier et al. | 60/752 |
| 5,335,501 | 8/1994 | Taylor . | |

FOREIGN PATENT DOCUMENTS

| | | |
|---|---|---|
| 0 651 207 A1 | 5/1995 | European Pat. Off. . |
| 28 36 539 A1 | 2/1980 | Germany . |

*Primary Examiner*—Louis J. Casaregola
*Attorney, Agent, or Firm*—Nixon & Vanderhye

[57] ABSTRACT

In a gas turbine having a transition region between a combustor and turbine stage including a transition piece duct extending between a combustor liner and the turbine stage; an impingement sleeve surrounding the transition piece, the impingement sleeve having a plurality of apertures therein; and a compressor diffuser directing compressor discharge air into the transition region, an improvement wherein the diffuser includes a pair of outer walls flaring outwardly in a direction of compressor discharge air flow; and a pair of baffles within a flow area defined by the pair of outer diffuser walls which divide the flow area into three discrete flow passages. One passage has a substantially radial flow component; a second passage has both radial and axial flow components; and a third passage has a substantially axial flow component.

6 Claims, 2 Drawing Sheets

TRI-PASSAGE DIFFUSER FOR A GAS TURBINE

TECHNICAL FIELD

This invention relates generally to gas turbines and specifically to a multi-passage diffuser at the gas turbine compressor discharge.

BACKGROUND PRIOR ART

Conventional gas turbine combustion systems employ multiple combustion chamber assemblies to achieve reliable and efficient turbine operation. Each combustion chamber includes a cylindrical combustor, a fuel injection system, and a transition piece that guides the flow of the hot gas from the combustor to the inlet of the turbine. Generally, a portion of the compressor discharge air is introduced directly into the combustor reaction zone to be mixed with the fuel and burned. The balance of the airflow serves either to quench the flame prior to the combustor discharge entering the turbine, or to cool the wall of the combustor and, in some cases, the transition piece.

In systems incorporating impingement cooled transition pieces, a hollow sleeve surrounds the transition piece, and the sleeve wall is perforated so that compressor discharge air will flow through the cooling apertures in the sleeve wall and impinge upon (and thus cool) the transition piece.

Because the transition piece is a structural member, it is desirable to have lower temperatures where the stresses are highest. This has proven difficult to achieve, but an acceptable compromise is to have uniform temperatures (at which the stresses are within allowable limits) all along the length of the transition piece. Thus, uniform flow pressures along the impingement sleeve are necessary to achieve the desired uniform temperatures.

Substantially straight axial diffusers are typically utilized in gas turbines at the compressor discharge location. If a passage diffuser occupies a large space in the mid-section of the machine, however, its ability to uniformly distribute flow is limited. In fact, for gas turbines having impingement cooled transition pieces, tests have shown severe transition piece temperature variations plus large impingement sleeve static pressure variations with the one-passage axial diffuser design. There has been at least one attempt in the gas turbine industry to utilize a curved diffuser to divert flow in a radial direction, (not in a system using impingement cooling of the transition piece), but the diffuser was formed to include only a single passage, so that uniform flow along the axial extent of the impingement sleeve was not achieved.

DISCLOSURE OF THE INVENTION

The present invention seeks to remedy the problems in the prior art by achieving a more uniform transition piece region flow to thereby maximize gas turbine output. At the same time, the invention permits the gas turbine rotor length to be minimized for rotor dynamic reasons, and the gas turbine length in general to be minimized to achieve additional cost savings as well.

In accordance with an exemplary embodiment of the invention, a three channel diffuser is provided at the compressor discharge to divert compressor flow in three different directions at the diffuser exit. This arrangement provides for uniform flow distribution along the impingement sleeve about the transition region and thus achieves desirable static pressure recovery.

In the exemplary embodiment, a flared exit passage at the compressor discharge is divided into three separate passages through the use of two baffles located within the discharge. While the outer walls of the discharge flare outwardly, the design of the baffles results in a cross sectional flow area for each channel which is substantially the same. This arrangement insures stable flow while at the same time provides more efficient and uniform distribution flow within the transition piece region to insure the desired uniform impingement cooling of the transition piece.

In accordance with one aspect of the invention, therefore, there is provided a compressor discharge diffuser for a gas turbine comprising an internal casing defining a pair of outer diffuser walls flaring outwardly in a direction of compressor discharge air flow; and a pair of baffles within a flow area defined by the pair of outer diffuser walls which divide the flow area into three discrete flow passages.

In accordance with another aspect of the invention, there is provided in a gas turbine having a transition region between a combustor and turbine stage including a transition piece duct extending between a combustor liner and the turbine stage; an impingement sleeve surrounding the transition piece, the impingement sleeve having a plurality of cooling apertures therein; and a compressor diffuser directing compressor discharge air into the transition region; the improvement wherein the diffuser includes a first passage shaped to direct compressor discharge air flow at least in a radial direction.

Other objects and advantages of the subject invention will become apparent from the detailed description which follows.

BEST MODE FOR CARRYING OUT THE INVENTION

Figure 1:
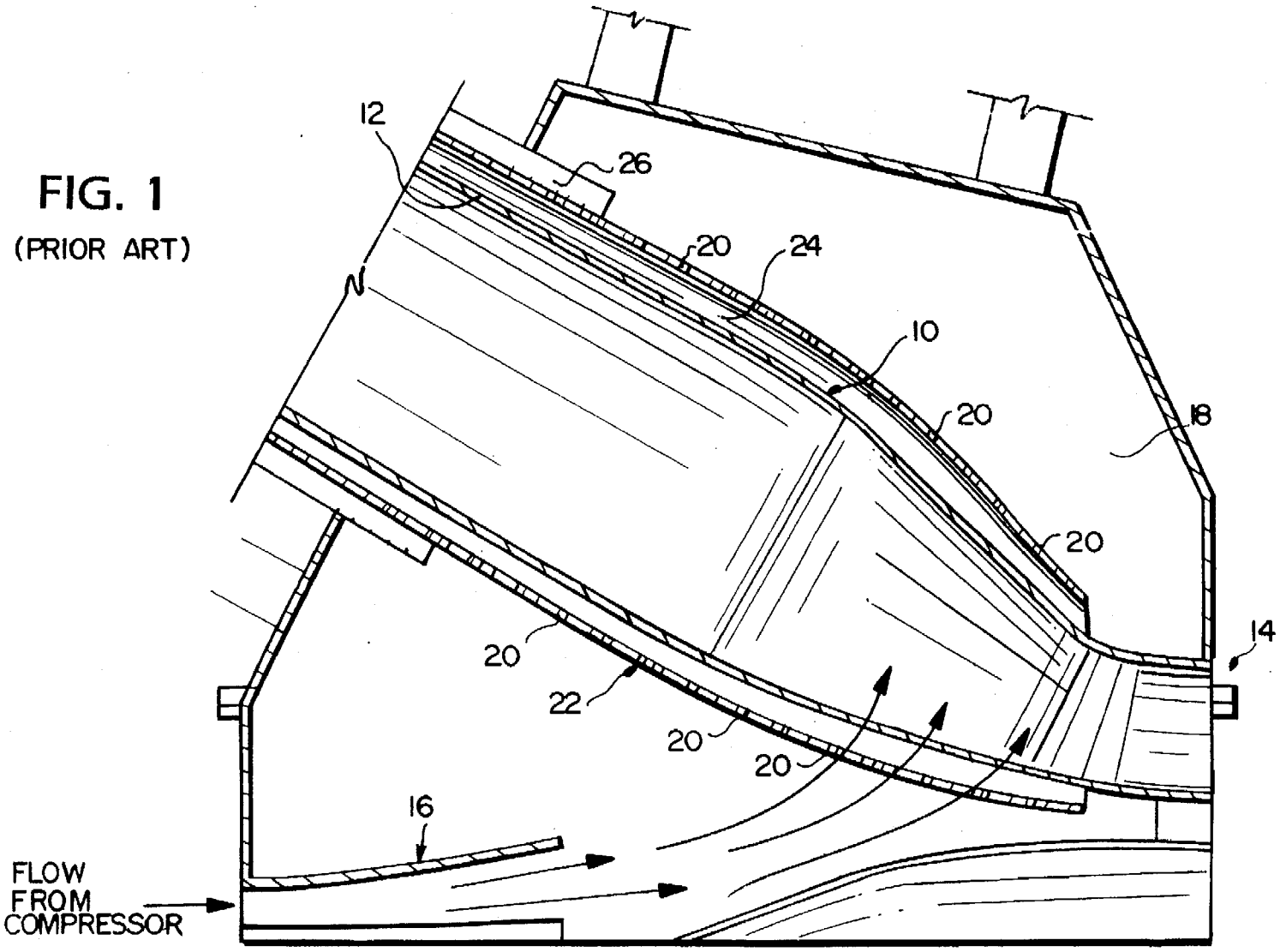
FIG. 1 (PRIOR ART)
FIG. 1 is a schematic cross section of a conventional axial compressor diffuser at the compressor discharge within a gas turbine incorporating an impingement cooled transition piece.

Turning to FIG. 1, a typical gas turbine includes a transition piece 10 by which the hot combustion gases from a combustor upstream of the combustion liner 12 are passed to the first stage of a turbine represented at 14. Flow from the gas turbine compressor exits an axial diffuser 16 and enters into a transition region 18. About 50% of the compressor discharge air passes through apertures 20 formed along and about an impingement sleeve 22 for flow in an annular region 24 between the transition piece 10 and the impingement sleeve 22. The remaining approximately 50% of the compressor discharge flow passes into the flow sleeve 26 and eventually mixes with gas turbine fuel in the combustor. As indicated by the flow arrows shown in FIG. 1, the compressor discharge flow in the conventional arrangement tends to be non-uniform and can result in significant transition piece temperature variations and significant impingement sleeve static pressure variations, as well as such variations negatively impact on gas turbine output.

Figure 2:
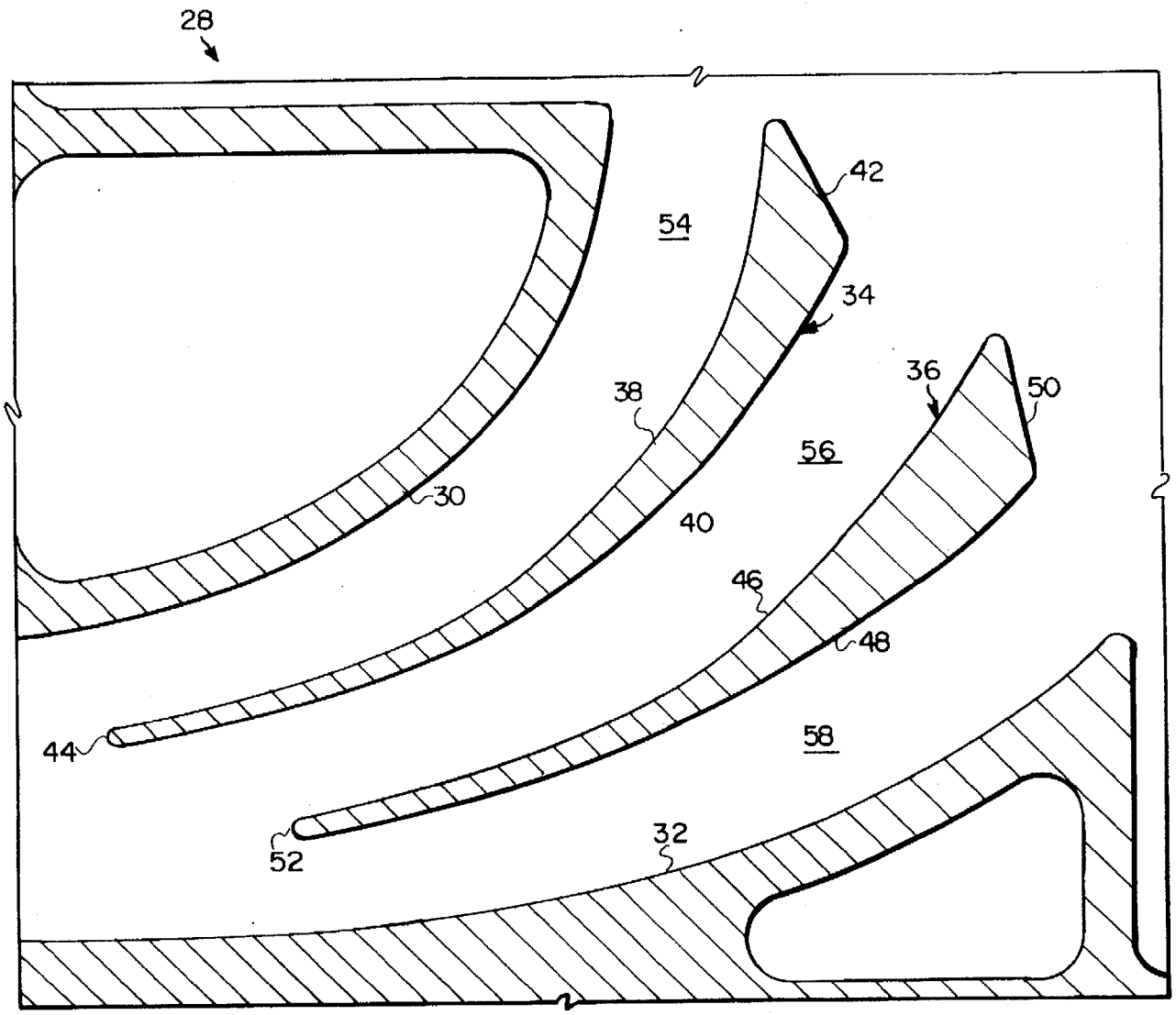
FIG. 2 is a cross sectional view of a tri-passage diffuser in accordance with this invention.

Turning to FIG. 2, a tri-passage diffuser 28 in accordance with this invention is shown in section, it being understood that the diffuser shown in the Figure is intended to replace the diffuser 16 shown in FIG. 1. This tri-passage diffuser 28 diverts the compressor discharge air stream into different radial and axial directions, toward the mid-section of the gas turbine transition region 18. Specifically, the diffuser 28 is defined by outwardly flaring (in the flow direction) outer walls 30 and 32 and a pair of interior baffles 34 and 36. The baffle 34 includes a pair of curved wall sections 38 and 40 which also taper outwardly in the flow direction and are connected by a downstream end wall 42. Wall sections 38, 40 are connected at an upstream end by a rounded edge 44. Similarly, the baffle 36 includes tapered walls 46 and 48 connected by a downstream end wall 50 and an upstream edge 52.

As can be seen from FIG. 2, the baffles 34 and 36 in conjunction with diffuser outer walls 30 and 32, form three diffuser passages 54, 56 and 58. The curvature of the diffuser walls 30 and 32 and the configuration of the baffles 34 and 36 are carefully chosen to insure that the flow area for each of the passages 54, 57 and 58 is substantially the same. At the same time, however, it can be seen that the flow is in three distinct directions. More specifically, passage 58 has a minor radial flow component and a substantial axial flow component. The intermediate passage 56 has substantially equal axial and radial flow components, whereas the passage 54 has a substantially radial flow component only. In this way, compressor discharge flow into the transition region 18 is more evenly distributed about the impingement sleeve 22 so as to substantially eliminate the previously experienced transition piece temperature variations and impingement sleeve static pressure variations associated with axial diffusers. In fact, tests have confirmed that with the tri-passage diffuser of this invention, there is no negative pressure along the entire length of the transition piece region 18 and that both pressure and temperature distributions along the length of the transition piece 10, and impingement sleeve 22 are relatively uniform.

It should also be noted that with the diffuser construction described herein, both the rotor length and overall turbine length can be shortened, thus providing overall increased turbine performance at reduced cost.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A compressor discharge diffuser for a gas turbine comprising:

an internal casing defining a pair of outer diffuser walls flaring outwardly in a direction of compressor discharge air flow; and a pair of baffles within a flow area defined by said pair of outer diffuser walls which divide said flow area into three discrete flow passage, wherein one of said three passages diverts compressor discharge air flow substantially radially; and further wherein another of said three passages diverts compressor discharge flow primarily in an axial direction.

2. The compressor discharge diffuser of claim 1 wherein each flow passage has a substantially identical cross-sectional flow area.

3. The compressor discharge diffuser of claim 1 wherein a third of said three passages diverts compressor discharge flow both axially and radially in substantially equal amounts.

4. In a gas turbine having a transition region between a combustor and turbine stage including a transition piece duct extending between a combustor liner and the turbine stage; an impingement sleeve surrounding said transition piece, said impingement sleeve having a plurality of cooling apertures therein; and a compressor diffuser adjacent said impingement sleeve for directing compressor discharge air into said transition region; the improvement wherein said diffuser includes a first passage shaped to direct compressor discharge air flow at least in a radial direction, toward said cooling apertures, and further wherein said diffuser includes a pair of outer walls flaring outwardly in a direction of compressor discharge air flow; and a pair of baffles within a flow area defined by said pair of outer diffuser walls which divide said flow area into three discrete flow passages including said first passage, said three flow passage having substantially identical cross-sectional flow areas.

5. In a gas turbine having a transition region between a combustor and turbine stage including a transition piece duct extending between a combustor liner and the turbine stage; an impingement sleeve surrounding said transition piece, said impingement sleeve having a plurality of cooling apertures therein; and a compressor diffuser directing compressor discharge air into said transition region; the improvement wherein said diffuser includes a first passage shaped to direct compressor discharge air flow at least in a radial direction; wherein said diffuser includes a pair of outer walls flaring outwardly in a direction of compressor discharge air flow; and a pair of baffles within a flow area defined by said pair of outer diffuser walls which divide said flow area into three discrete flow passages including said first passage; and wherein a second of said three passages diverts compressor discharge flow primarily in an axial direction.

6. The improvement of claim 5 wherein a third of said three passages diverts compressor discharge flow both axially and radially in substantially equal amounts.

* * * * *